US007188986B1

(12) United States Patent
Harwood

(10) Patent No.: US 7,188,986 B1
(45) Date of Patent: Mar. 13, 2007

(54) ILLUMINATED SIGN

(76) Inventor: Ronald Paul Harwood, 31110 Applewood, Farmington Hills, MI (US) 48331

( * ) Notice: Subject to any disclaimer, the term of this patent is extended or adjusted under 35 U.S.C. 154(b) by 0 days.

(21) Appl. No.: 11/324,602

(22) Filed: Jan. 3, 2006

(51) Int. Cl.
*G09F 13/18* (2006.01)

(52) U.S. Cl. ..... 362/559; 362/431; 362/551; 362/554; 362/812; 40/547; 40/557

(58) Field of Classification Search ..... 362/431, 362/551, 554, 559, 583, 812; 40/547, 557
See application file for complete search history.

(56) References Cited

U.S. PATENT DOCUMENTS

| | | | | |
|---|---|---|---|---|
| 3,414,999 | A * | 12/1968 | Mason | 40/576 |
| 4,929,936 | A | 5/1990 | Friedman et al. | |
| 4,951,405 | A * | 8/1990 | Sabala | 40/551 |
| 4,951,406 | A | 8/1990 | Lemire | |
| 5,151,679 | A | 9/1992 | Dimmick | |
| 5,832,642 | A | 11/1998 | Dalton | |
| 6,009,650 | A | 1/2000 | Lamparter | |
| 6,099,933 | A | 8/2000 | Lamparter | |
| 6,205,282 | B1 * | 3/2001 | Gaydoul | 385/146 |
| 6,240,664 | B1 | 6/2001 | Hjaltason | |
| 6,409,358 | B1 | 6/2002 | Grover | |
| 6,471,388 | B1 | 10/2002 | Marsh | |
| 6,489,733 | B1 | 12/2002 | Schmidt et al. | |
| 6,511,195 | B2 | 1/2003 | Marinacci | |
| 6,705,033 | B1 | 3/2004 | Greene et al. | |
| 6,796,700 | B2 | 9/2004 | Kraft | |
| 6,942,366 | B2 | 9/2005 | Mohacsi | |
| 2002/0003697 | A1 | 1/2002 | Chien | |
| 2002/0159245 | A1 | 10/2002 | Murasko et al. | |
| 2002/0159741 | A1 | 10/2002 | Graves et al. | |
| 2002/0172050 | A1 | 11/2002 | Marinacci | |
| 2003/0099105 | A1 | 5/2003 | Watson | |
| 2003/0147256 | A1 | 8/2003 | Kraft | |
| 2003/0179577 | A1 | 9/2003 | Marsh | |
| 2003/0204977 | A1 | 11/2003 | Hong | |
| 2004/0004844 | A1 | 1/2004 | Ryan, Jr. | |
| 2004/0047146 | A1 | 3/2004 | Galoob et al. | |
| 2004/0062032 | A1 | 4/2004 | Mass | |
| 2004/0080929 | A1 | 4/2004 | Golle et al. | |
| 2004/0095741 | A1 | 5/2004 | Chen | |
| 2004/0107615 | A1 | 6/2004 | Pare | |
| 2004/0109330 | A1 | 6/2004 | Pare | |
| 2005/0055856 | A1 | 3/2005 | Johnston et al. | |

* cited by examiner

*Primary Examiner*—Stephen F Husar
*Assistant Examiner*—Meghan K. Dunwiddie
(74) *Attorney, Agent, or Firm*—Brooks Kushman P.C.

(57) ABSTRACT

A lamp is disclosed with a light source for illuminating a region, such as a thoroughfare. A sign is provided associated with the lamp and spaced apart from the light source of the lamp. A light conveyable medium has an input oriented proximate to the light source for receiving light from the light source and transmitting the light to an output end which is directed at the sign for illuminating the sign.

22 Claims, 3 Drawing Sheets

ILLUMINATED SIGN

BACKGROUND OF THE INVENTION

1. Field of the Invention

The present invention relates to signs, more particularly to illuminated signs.

2. Background Art

Signs, such as street signs, are utilized for conveying a message, such as the name of a street to a passerby. When lighting is poor, it may be difficult for a passerby to view the sign. Conventionally, signs have been provided with reflective material to absorb and reflect available ambient light. Street signs have been provided with a light source for illuminating the street sign.

Oftentimes, a sign, such as a street sign, may be provided on a lamp post with an associated lamp, which is utilized for illuminating an underlying region, such as a thoroughfare. Accordingly, the prior art has oriented signs, such as street signs, so that the lamp also illuminates the street sign.

SUMMARY OF THE INVENTION

An embodiment of the present invention is to provide a lamp with a sign. The lamp is the light source for illuminating a region of an underlying thoroughfare. The sign may be spaced apart from the light source. A light conveyable medium has an input oriented proximate to the light source for receiving light from the light source, and an output directed at the sign for transmitting light from the light source to the sign.

Another embodiment of the present invention is to provide a method for illuminating a sign on a lamp post. The method includes mounting a light collector to a lamp post adjacent to a lamp and concealed within the lamp for collecting light from the lamp. A light conveyable medium is connected to the light collector for conveying the light away from the light collector. A light emitter is mounted to the lamp post proximate to a sign. The light emitter is connected to the light conveyable medium for receiving the light from the light conveyable medium and transmitting the light to the sign for illuminating the sign.

The above embodiments and other embodiments, objects, features, and advantages of the present invention are readily apparent from the following detailed description of the embodiments of the invention when taken in connection with the accompanying drawings.

DESCRIPTION OF EMBODIMENTS OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
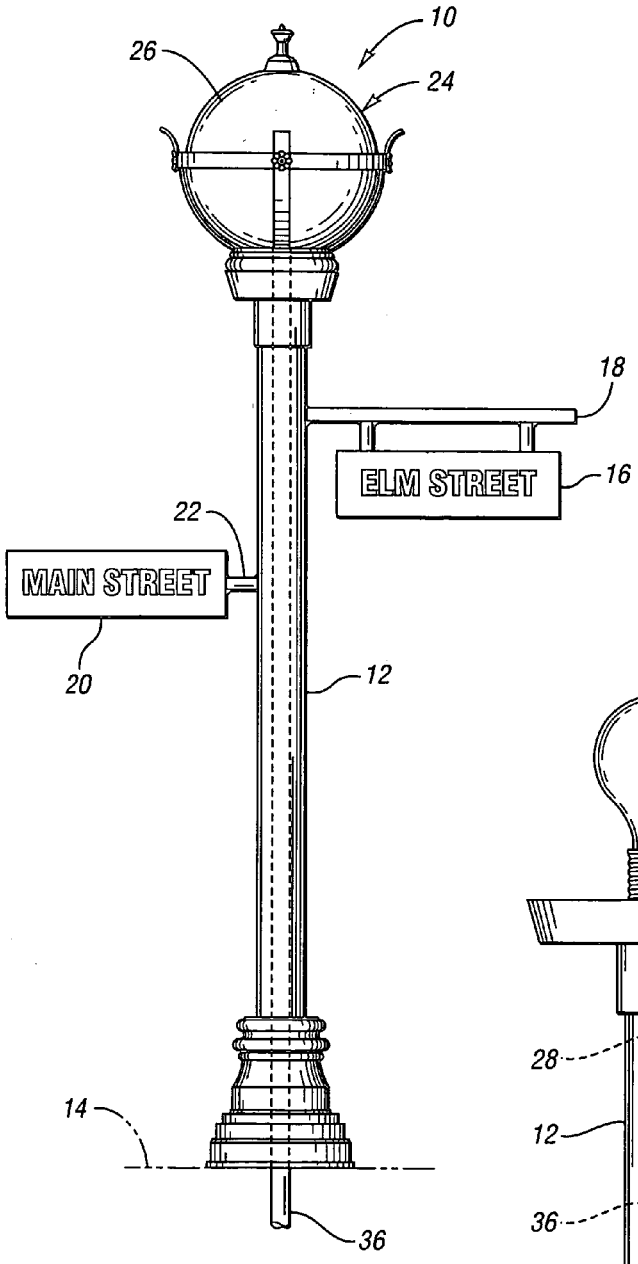
FIG. 1 is a front side elevation view of a lamp with a sign in accordance with the present invention.

With reference now to FIG. 1, a lamp is illustrated in accordance with the present invention and is referenced generally by numeral 10. The lamp 10 includes a lamp post 12 that is secured to an underlying support surface, such as ground 14, or any other thoroughfare, for elevating the lamp 10 therefrom. The lamp 10 illuminates a region of the thoroughfare for assisting passersby, travelers, or the like in viewing a region of the thoroughfare.

The lamp 10 includes a sign, such as a street sign, mounted thereto. Various signs are contemplated by the present invention, such as a sign 16, which hangs from a bracket 18. Additionally, a sign 20 may be provided on an arm mount 22. Of course, any number of signs may be provided as necessitated by the environment or application.

An aspect of the prior art is to illuminate signs that are associated with a lamp by light emitted from the lamp. According to this prior art aspect, the signs are positioned relative to the lamp to receive light directly from the lamp. Otherwise, indirect or less preferred lighting may be provided to the signs from the lamp. Another aspect of the prior art is to provide a secondary light source on the lamp for lighting the sign. By providing a secondary light source, maintenance of the lamp is thereby greatly increased.

Accordingly, the present invention provides embodiments that may illuminate the associated sign 16 or signs 16, 20 from a primary light source 24 of the lamp 10.

Figure 2:
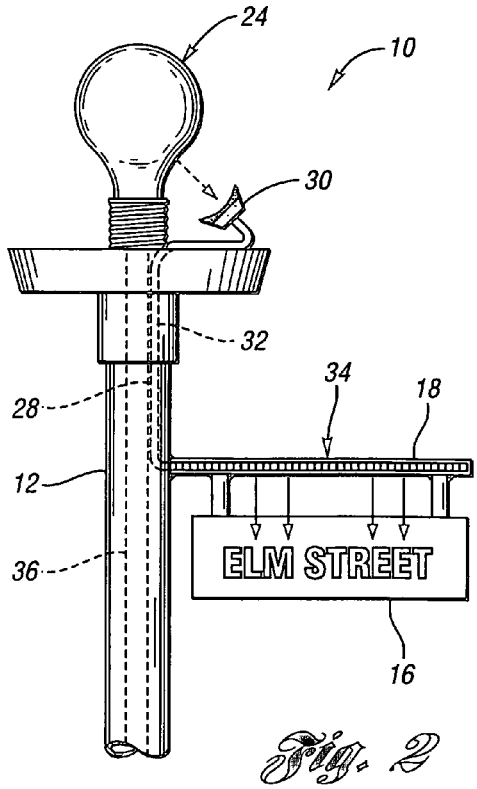
FIG. 2 is an enlarged view of the lamp and sign of FIG. 1, illustrated with the lamp partially disassembled.

Referring to FIG. 2, the lamp 10 is illustrated partially disassembled with a cover 26 removed for revealing the light source 24 as, for example, an incandescent light bulb. The lamp 10 of the embodiment of FIG. 2 is illustrated with a light conducting conduit which receives light from the primary light source 24 and conveys the light to the sign 16. The light conducting conduit is depicted as a fiber optic cable 28 in FIG. 2, by way of example. Although a fiber optic cable 28 is illustrated, the invention contemplates that any light conveyable medium may be utilized within the spirit and scope of the present invention.

The fiber optic cable 28 includes an input end oriented proximate to the primary light source 24 for collecting light from the primary light source 24. The fiber optic cable 28 also includes an output end directed at the sign 16 for transmitting light from the light source 24 to the sign 16. Thus, the orientation of the sign 16 relative to the light source 24 is not limited as in prior art signs, which require lighting directly from the primary light source 24. Additionally, the present invention avoids the unnecessary costs associated with a secondary light source, energy for powering a secondary light source, and labor and materials for maintaining a secondary light source.

The input end of the light conducting conduit may be utilized for receiving light from the light source 24. Alternatively, a light concentration tool such as a light collector 30 may be mounted to the input end of the fiber optic cable 28 for collecting light from the primary light source 24, focusing the light and transmitting the light through the fiber optic cable 28. For example, the light may be concentrated by a lens, such as a concave lens, or a reflector. The invention contemplates light distribution with various light concentration modifications, or with no light concentration modification within the spirit and scope of the present invention.

A filter 32 may be provided with the fiber optic cable 28 for regulating the amplitude of the light conveyed through the fiber optic cable 28.

A light emitter 34 may be provided at the output end of the fiber optic cable 28 for transmitting the light from the fiber optic cable 28 to the sign 16. The light emitter 34 may be provided by a distal end of the light conducting conduit or by utilization of an additional mechanism, such as a reflector. The light emitter 34 may be directed at the sign 16 for providing a desired illumination of the sign 16. The light emitter 34 may transmit light along its length for providing even distribution of light upon the sign 16.

The invention contemplates various light collectors and emitters within the spirit and scope of the present invention. For example the light collector and emitter of a light conducting conduit embodiment may be provided by the distal ends of the conduit. Additionally, a lens or reflector may be employed for concentrating, focusing, redirecting or otherwise manipulating the light from the light source to the sign. The light conducting conduit may be a single member or plural members, such as a single fiber optic cable or multiple strands of a fiber optic cable or fiber optic cable bundle. Various forms of light distribution are also contemplated. Reflectors may be provided at the sign. Incisions may be formed upon the light conducting conduit for conveying light to a predefined location or pattern. Alternatively, the light collector and light emitter may be formed integrally with the light conducting conduit.

With reference again to FIG. 1, wiring conduit 36 may be provided to the lamp post 12 for conveying a power source through the lamp post 12 to the light source 24. Additionally, other wiring or signals may be provided within the lamp post 12 as well. Alternatively, a rechargeable power source may be provided, which may also be in communication with the wiring conduit 36, for powering the light source 24 regularly or during a power outage.

Referring again to FIG. 2, the fiber optic cable 28 may also be partially concealed within the lamp post 12 as illustrated, so that the fiber optic cable 28 does not disrupt or obfuscate an ornamental or aesthetic appearance of the lamp 10 when viewed externally. Additionally, the fiber optic cable 28 may be partially concealed within the lamp cover 26. Likewise, the light collector 30 may also be concealed within the cover 26. Further, the output end of the fiber optic cable 28 and the light emitter 34 may be concealed, at least partially, within the bracket 18. Moreover, the light conveyable mechanism for transferring light from the primary light source 24 to the sign 16 may be generally concealed within the lamp 10.

Figure 3:
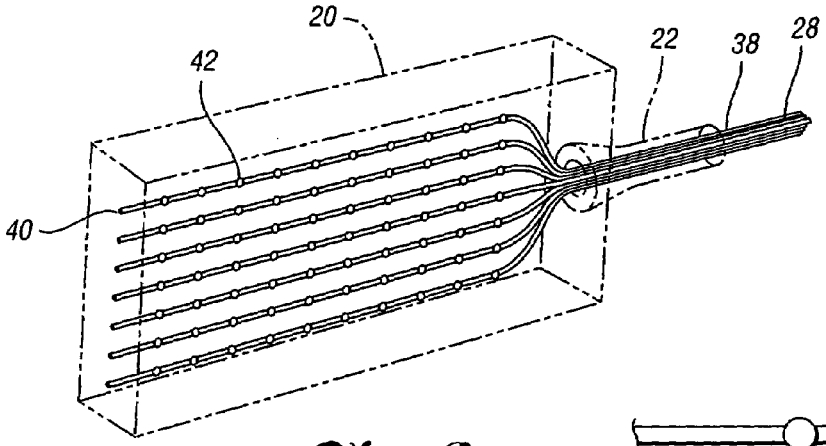
FIG. 3 is a perspective view of a sign in accordance with the present invention.

The arm mount 22 and sign 20 are illustrated in greater detail in FIG. 3. The sign 20 may be formed from a generally translucent material. Sign information, such as text, may be provided by an opaque medium displayed upon exterior surfaces of the sign 20. The fiber optic cable 28 may include a fiber bundle 38 at its output end. The fiber bundle 38 may be embodied collectively by a series of fiber strands 40. The fiber strands 40 of the fiber bundle 38 diverge within the sign 20 for spanning an area of targeted illumination within the sign 20.

Figure 4:
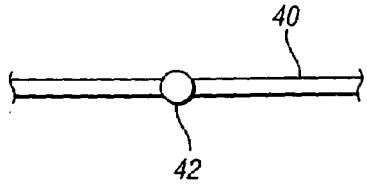
FIG. 4 is an enlarged side elevation view of an emitter node of the sign of FIG. 3.

Referring now to FIG. 4, each fiber strand 40 is depicted including at least one emitter node 42 for transmitting light from the emitter node 42 along the fiber strands 40. Referring again to FIG. 3, a series of emitter nodes 42 are provided, for example, along the fiber strands 40 of the fiber bundle 38. The emitter nodes 42 are spaced incrementally for providing even distribution of light within the sign 20.

Figure 5:
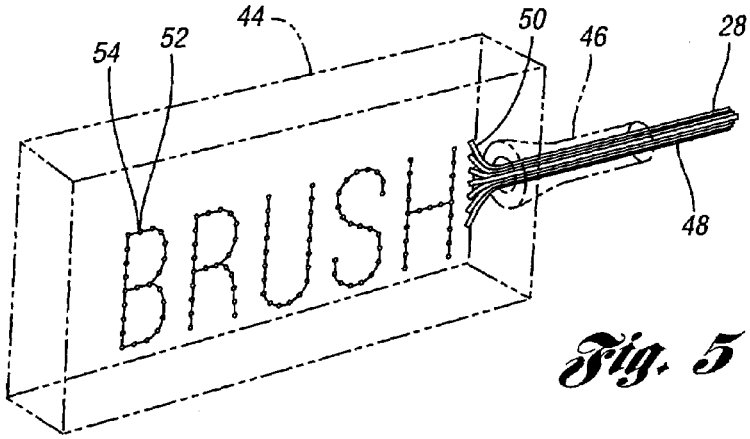
FIG. 5 is a perspective view of another sign in accordance with the present invention.
Figure 6:
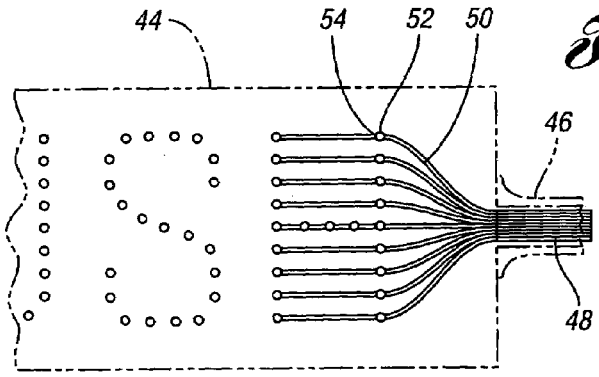
FIG. 6 is an enlarged side elevation view of the sign of FIG. 5.

With reference now to FIGS. 5 and 6, another sign 44 is illustrated attached to an arm mount 46 for securing the sign 44 to the lamp post 12. An output end of the fiber optic cable 28 may be provided within the arm mount 46. A fiber bundle 48 is illustrated at the output end of the fiber optic cable 28. The fiber bundle 48 includes a series of fiber strands 50, which diverge within the sign 44. The sign 44 may be provided with an opaque material wherein signage, such as text, is provided by a plurality of apertures 52 formed within the sign 44. Similar to the prior embodiment, the fiber strands 50 may be provided with a series of emitter nodes 54, each oriented within a sign aperture 52 for transmitting light through the sign 44. Thus, the text of the sign may be collectively provided by an arrangement of the emitter nodes 54. Thus, rather than illuminating opaque text, information may be provided collectively by a series of illuminated nodes within the text.

The invention contemplates that the various sign illumination techniques detailed herein may be provided within a new lamp post. Likewise, the invention contemplates that old or existing lamp posts may be retrofit to include an illuminated street sign in accordance with the present invention.

Figure 7:
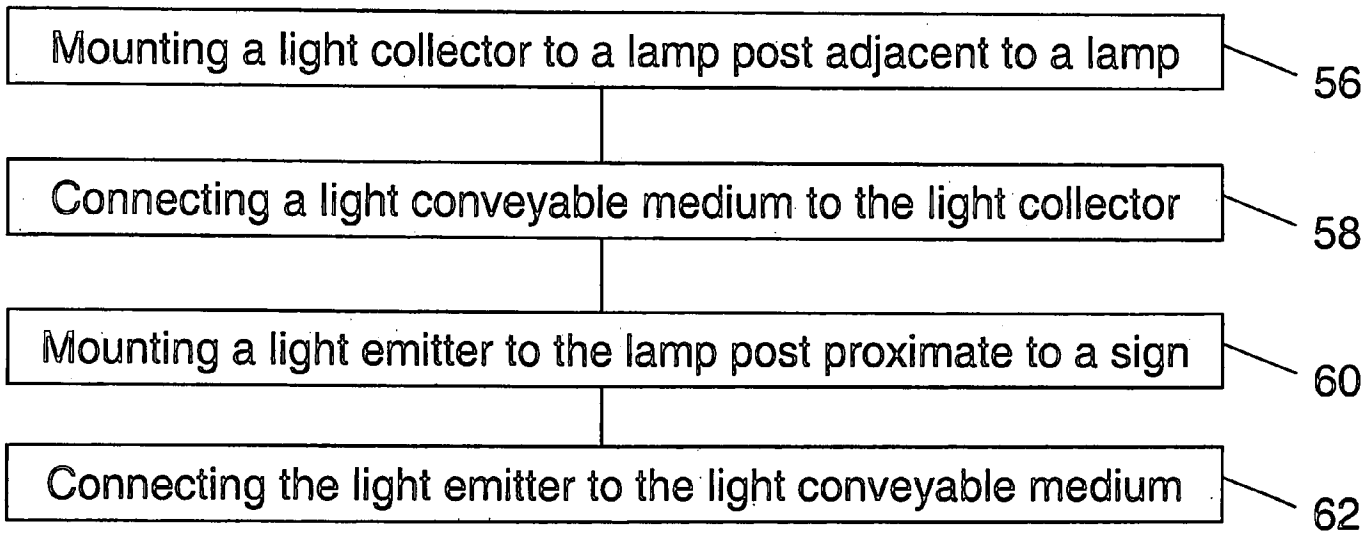
FIG. 7 is a flow chart depicting a method in accordance with the present invention.

With reference now to FIG. 7, a method is illustrated for illuminating a sign by utilization of a primary light source. At block 56, a light collector is mounted to a lamp post adjacent to a lamp for receiving light from the lamp. At block 58, a light conveyable medium is connected to the light collector for receiving light from the light collector. At block 60, a light emitter is mounted to the lamp post proximate to a sign. The light emitter is connected to the light conveyable medium at block 62 for receiving the light from the light conveyable medium and transmitting the light to the sign, thereby illuminating the sign. Thus, the present invention may be embodied on new or preexisting lamps, lamp posts, light fixtures, or the like.

The invention contemplates that the lamp and illuminated sign of the present invention may be utilized in various outdoor and indoor public environments and thoroughfares. Such areas may include city streets, parks, residential neighborhoods, office buildings, campuses, exterior walkways, shopping malls, casinos, dealerships, sports venues, atriums, amusement parks, wharfs, or the like.

In summary, an illuminated sign, a light fixture therefore, and a method for illuminating a sign are disclosed which permit the sign to be placed anywhere that is readily viewable regardless of direct light that may be applied thereto, while reducing the amount of energy required for illuminating the thoroughfare and the sign by redirecting some of the light from the primary light source to the sign. Additionally, required maintenance is reduced by omitting the requirement of a secondary light source.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A lamp having a sign, comprising:

a light source for illuminating a region of an underlying thoroughfare;

a sign spaced apart from the light source; and a light conveyable medium having an input oriented proximate to the light source for receiving light therefrom and an output directed at the sign for transmitting light from the light source to the sign;

wherein the light source further comprises a lamp with a cover, and wherein the light conveyable medium is at least partially concealed within the cover.

2. The lamp of claim 1 wherein the light conveyable medium further comprises a fiber optic cable for conveying the light from the light source to the sign.

3. The lamp of claim 1 wherein the light conveyable medium further comprises a filter for filtering the light that is conveyed to the sign.

4. The lamp of claim 1 wherein the light conveyable medium is partially concealed within the sign.

5. The lamp of claim 1 wherein the light conveyable medium further comprises a light collector oriented adjacent to the light source for receiving light therefrom.

6. The lamp of claim 1 wherein the light conveyable medium further comprises a lens for varying a concentration of light conveyed therethrough.

7. The lamp of claim 1 further comprising a lamp post wherein the light source is mounted on the lamp post.

8. The lamp of claim 7 wherein the sign is mounted on the lamp post.

9. The lamp of claim 1 wherein the light conveyable medium further comprises a light emitter oriented adjacent to the sign for transmitting the light to the sign for illuminating the sign.

10. The lamp of claim 9 further comprising a bracket for mounting the sign to the lamp, wherein the light emitter is mounted to the bracket.

11. The lamp of claim 9 wherein the sign includes a translucent portion and an opaque portion and the light emitter is disposed within the translucent portion and behind the opaque portion for illuminating the opaque portion of the sign.

12. The lamp of claim 9 wherein the light emitter further comprises a fiber bundle for illuminating the sign.

13. The lamp of claim 12 wherein the fiber bundle diverges to illuminate a region of the sign.

14. The lamp of claim 12 wherein the fiber bundle further comprises a plurality of fiber strands, each having at least one emitter node for illuminating a portion of the sign.

15. The lamp of claim 12 wherein plurality of emitter nodes are arranged to collectively form a display on the sign.

16. A lamp having a sign, comprising:

a light source for illuminating a region;

a sign spaced apart from the light source;

a light conveyable medium having an input oriented proximate to the light source for receiving light therefrom and an output directed at the sign for transmitting light from the light source to the sign; and a bracket for mounting the sign to the lamp, wherein the light conveyable medium is partially concealed within the bracket.

17. A lamp having a sign, comprising:

a light source for illuminating a region;

a sign spaced apart from the light source;

a light conveyable medium having an input oriented proximate to the light source for receiving light therefrom and an output directed at the sign for transmitting light from the light source to the sign; and a lamp post wherein the light source is mounted on the lamp post;

wherein the light conveyable medium is generally concealed within the lamp post.

18. A lamp having a sign, comprising:

a light source for illuminating a region;

a sign spaced apart from the light source; and a light conveyable medium having an input oriented proximate to the light source for receiving light therefrom and an output directed at the sign for transmitting light from the light source to the sign;

wherein the light conveyable medium further comprises a light emitter oriented adjacent to the sign for transmitting the light to the sign for illuminating the sign; and wherein the light emitter has a length and the light emitter transmits light along its length, the light emitter length being aligned with the sign for transmitting light from the length of the light emitter to the sign.

19. A lamp having a sign, comprising:

a lamp post mounted to an underlying support surface;

a light source mounted to the lamp post for illuminating an associated region;

a power source oriented in the lamp post in cooperation with the light source for illuminating the light source;

a sign mounted to the lamp post outside of the illuminated region;

a light collector oriented adjacent to the light source for receiving light from the light source;

a fiber optic member in cooperation with the light collector for conveying the light away from the light collector; and a light emitter oriented adjacent to the sign in cooperation with the fiber optic member for receiving the light from the fiber optic member and transmitting the light to the sign for illuminating the sign wherein the light source further comprises a lamp with a cover, and wherein the light collector is concealed within the cover.

20. A method for illuminating a sign on a lamp post comprising:

mounting a light collector to a lamp post adjacent to a lamp and concealed within a cover of the lamp, for collecting light from the lamp;

connecting a light conveyable medium to the light collector for conveying the light away from the light collector;

mounting a light emitter to the lamp post proximate to a sign; and connecting the light emitter to the light conveyable medium for receiving the light from the light conveyable medium and transmitting the light to the sign for illuminating the sign.

21. A lamp having a sign, comprising:

a light source for illuminating a region of an underlying thoroughfare;

a sign spaced apart from the light source; and a light conveyable medium having an input oriented proximate to the light source for receiving light therefrom and an output directed at the sign for transmitting light from the light source to the sign;

wherein the light source further comprises a luminaire, and wherein the light conveyable medium is at least partially concealed within the luminaire.

22. A lamp having a sign, comprising:

a light source for illuminating a region of an underlying thoroughfare;

a sign spaced apart from the light source; and a light conveyable medium having an input oriented proximate to the light source for receiving light therefrom and an output directed at the sign for transmitting light from the light source to the sign;

wherein the light conveyable medium further comprises a light collector oriented adjacent to the light source for receiving light therefrom; and wherein the light source further comprises a lamp with a cover, and wherein the light collector is concealed within the cover.

* * * * *